United States Patent [19]

Higashiguchi

[11] 4,396,662

[45] Aug. 2, 1983

[54] TRANSFERABLE FLOCKED FIBER DESIGN MATERIAL AND METHOD OF MAKING SAME

[76] Inventor: Shigehiko Higashiguchi, 3-4-2, Honjo, Sumida-ku, Tokyo, Japan

[21] Appl. No.: 348,924

[22] Filed: Feb. 16, 1982

Related U.S. Application Data

[63] Continuation-in-part of Ser. No. 189,324, Sep. 22, 1980, abandoned.

[30] Foreign Application Priority Data

Apr. 3, 1980 [JP] Japan ..... 55-42863

[51] Int. Cl.[3] ..... B44C 3/02

[52] U.S. Cl. ..... 428/90; 156/72; 156/230; 156/234; 156/235; 156/240; 427/206; 428/914

[58] Field of Search ..... 428/90, 914; 156/72, 156/230, 234, 235, 240; 427/206

[56] References Cited

U.S. PATENT DOCUMENTS 4,142,929 3/1979 Otomine ..... 428/90
4,201,810 5/1980 Higashiguchi ..... 428/914

*Primary Examiner*—Marion McCamish
*Attorney, Agent, or Firm*—Pearne, Gordon, Sessions, McCoy, Granger & Tilberry

[57] ABSTRACT

A transferable flocked fiber design material the fibers of which are to be transferred onto a shirt to be decorated with the design material to form a desired design pattern thereon. The fibers are releasably flocked at one end to one surface of the release support base by means of the release adhesive layer applied to the one surface of the support base and applied at the other ends with the fiber transfer adhesive layer containing the hot melt adhesive.

8 Claims, 6 Drawing Figures

TRANSFERABLE FLOCKED FIBER DESIGN MATERIAL AND METHOD OF MAKING SAME

This application is a continuation-in-part of my application Ser. No. 189,324, filed Sept. 22, 1980, entitled "Transferable Flocked Fiber Design Material and Method of Making Same," now abandoned.

BACKGROUND OF THE INVENTION

This invention relates to a method for preparing a transferable flocked fiber design material, and more particularly to a method for preparing a transferable flocked fiber design material in which fibers are releasably flocked to a release support base to be permanently transferred in a desired design pattern consisting of letters and/or symbols onto an ultimate support member such as a shirt which is to be decorated with the design material. This invention also relates to a transferable flocked fiber design material prepared by the method.

U.S. Pat. Nos. 4,142,929 and 4,201,810, Japanese Pat. No. 990,039, and Japanese Patent Application Publication No. 4768/1961 show transferable flocked fiber design materials, and this invention relates to improvements over the prior art disclosed in these prior publications.

There have been proposed and practically employed a number of methods for preparing the above-mentioned transferable flocked fiber design material. On of the prior art methods comprises the steps of applying adhesive to one surface of a release support base such as a paper sheet, which adhesive is capable of releasable flocking fibers to the support base, flocking short fibers at one end in adjacent and erect relationship to the adhesive applied surface of the support base by electrostatic blasting or the like, and applying thermoplastic adhesive to the other ends of the releasably flocked fibers, which thermoplastic adhesive is capable of permanently transferring and securing the fibers onto and to a permanent support member such as a shirt which is to be decorated with the design material. The fibers in the transferable flocked fiber design material can be directly transferred onto a shirt or the like. In some cases, the release support base is previously printed with a design pattern before the fibers are flocked to the support base. The fibers of the thus-obtained transferable flocked fiber design material are ready to be permanently transferred onto an ultimate support member or shirt and secured thereto by means of the thermoplastic adhesive when the adhesive fuses under heat and pressure. The thermoplastic adhesive layer application step may be performed either by (a) applying the adhesive to the other ends of all the flocked fibers or (b) applying the adhesive to other ends of selected ones of the flocked fibers in a desired design pattern.

When the fibers in the transferable flocked fiber design material prepared by the method including the thermoplastic adhesive application step (a) are transferred onto and permanently secured in a desired design pattern to an ultimate support member such as a shirt which is to be decorated with the design material, the design material is placed onto the shirt with the thermoplastic adhesive layer in contact with the shirt and a heated platen bearing such a desired pattern is applied to the transferable design material on the surface of the release support base opposite from the release adhesive applied surface thereof under pressure whereby the thermoplastic adhesive fuses in a pattern substantially corresponding to the configuration of the design pattern on the platen, resulting in the adhering of selected ones of the fibers in the pattern to the shirt.

After the thermoplastic adhesive has fused sufficiently to permanently transfer the fibers to the shirt, the platen is removed from the design material and the transferred fibers are left as they are until the thermoplastic adhesive cools down and solidifies, whereupon the fibers are firmly secured in the design pattern to the shirt. Thereafter, the transferable design material is pulled away from the shirt to separate the release support base, release adhesive layer, and the rest of the fibers from the thermoplastic adhesive layer and the fibers in the design pattern which are firmly secured to the shirt. Such separation can be easily performed, since the fibers are releasably flocked to the support base by means of the release adhesive layer.

The fibers can also be transferred in a desired pattern onto the shirt by cutting the design pattern out of the design material to the desired pattern, placing the cut design pattern onto a shirt, and applying heat and pressure to the design pattern by means of a heating means such as an iron, as disclosed in Japanese Patent Application Publication No. 4768/1961. The fibers of the tranferable flocked fiber design material produced by the method including the thermoplastic adhesive layer application step (b) can be similarly transferred onto the shirt by placing the design material onto the shirt, with the thermoplastic adhesive layer in contact with the shirt, and applying heat and pressure to the design material by means of a heating means such as an iron, as disclosed in Japanese Utility Model Application No. 90892/1973.

As to the adhesive forming the release adhesive layer on the release support base, in Japanese patent Application Publication No. 4768/1961, wherein the method including the thermoplastic adhesive layer application step (a) is shown, a specific adhesive mixture is disclosed, The adhesive mixture is prepared by immersing 10 g of polyethylene glycol into 50 $cm^3$ of cold water to allow the polyethylene glycol to swell therein and adding 25 g of kaolin powder and 10 g of zinc stearate to the polyethylene glycol, being followed by kneading of the mixture, and in Japanese Utility Model Application No. 90892/1973, there is disclosed an adhesive composition comprising a water-naphtha-emulsifier mixture solution having Japan wax, glazing agent, penetrant, and a mixture adhesive of acrylic emulsion adhesive and vinyl acetate emulsion adhesive blended therewith.

The water, naphtha, and emulsifier mixture solution in the release adhesive layer forming blend as disclosed in Japanese Utility Model Application No. 90892/1973 serves to minimize the swelling of the release support base when the release adhesive layer is applied thereto, and also minimizes the stiffening of the support base after the drying of the mixture solution. The Japan wax in the blend serves to allow the fibers in the releasably flocked fiber layer to easily separate from the release support base without adhering to the base when the fibers are transferred onto the shirt and prevent the fibers from carrying fragments of the release adhesive layer therewith. The glazing agent in the blend eliminates variations in the surface of the fibers caused by the release adhesive. The penetrant in the blend accelerates the penetration of color ink when the ink is stenciled into the fiber layer. The adhesive mixture of acrylic emulsion adhesive and vinyl acetate emulsion adhesive in the blend minimizes the swelling and contraction of the permanent support member, such as a shirt, under varying temperature and humidity conditions, as well as prevention of the stiffening of the shirt when the fibers are transferred onto the shirt.

However, the transferable flocked fiber design material disclosed in Japanese Patent Application Publication No. 4768/1961 has the disadvantage that the wax material in the release adhesive layer adheres to the free or other ends of the fibers opposite from the ends thereof flocked to the release support base and tests conducted on the transferable flocked fiber design material disclosed in Japanese Utility Model Application No. 90982/1973 show that the employment of the mixture solution of water, naphtha and emulsifier is inconvenient in preparing the assembly of the release support base, release support layer, and fibers. That is, the water-naphtha-emulsifier mixture solution has been generally employed as a filler in the silk screen printing art, but when a release adhesive layer forming blend containing the filler is applied to the release support base, fibers are releasably flocked to the adhesive applied support base and the resulting product is passed through a heat drier to ensure releasable flocking of the fibers to the support base, and it has been found that there is a possibility of explosion of the drier because naphtha is a highly inflammable volatile matter.

After the heat drying of the assembly, including the release support base, the release adhesive layer applied to the base and the fibers releasably flocked at one end to the base by means of the adhesive layer, the other or free ends of selected ones of the fibers opposite from the ends thereof flocked to the base are printed in a desired design pattern, a thermoplastic adhesive layer is applied to the other ends of the selected fibers, and the resulting assembly is heat-dried to firmly secure the thermoplastic adhesive layer to the fiber ends and the fibers are transferred from the thus-obtained transferable flocked fiber design material onto a permanent support member such as a shirt, there are the disadvantages that since the fibers have been too firmly flocked to the support base to be separated from the base and that if the fibers are forcibly pulled off the base with a high force, a portion of the release adhesive layer is also separated from the support base and remains on the separated fibers whereby when transferred onto the shirt, the fibers forming the desired design pattern given an unsightly appearance to the shirt.

The heat drying of the base, release adhesive layer and flocked fiber assembly is one essential step to firmly flock the fibers to the base in the transferable flocked fiber production method mentioned just above. If the heat drying step is not performed, the flocked fibers tend to easily come off the support base when the design material is subjected to a slight impact.

The heat drying to be formed after the thermoplastic or fiber transfer adhesive layer has been applied to the free ends of the flocked fibers is also one essential step to firmly secure the adhesive to the fiber ends in the transferable design material production method. If the second heat drying step is not performed, the flocked fiber transfer adhesive layer tends to easily dislodge when the fiber transfer adhesive layer is subjected to an external force.

The flocked fiber transfer adhesive is a thermoplastic adhesive. In the transfer of the flocked fibers from the transferable flocked fiber design material onto a shirt with the transfer adhesive layer maintained in contact with the shirt, when the design material is subjected to heat and pressure by means of an iron or the like, the thermoplastic adhesive fuses to become tacky to thereby secure the fibers to the shirt. However, in such a case, the fibers frequently tend to lie down on the fused adhesive.

When the fibers are transferred onto a shirt, with the fibers lying down on the fused tacky adhesive by tearing the release support base off the shirt, the lying-down fibers cannot be secured to the shirt in erect position whereby the transferred fibers form an unsightly design pattern on the shirt.

SUMMARY OF THE INVENTION

Therefore, the present invention is to provide a transferable flocked fiber design material which can effectively eliminate the disadvantages inherent in the prior art transferable flocked fiber design material.

One object of the present invention is to provide a transferable flocked fiber design material which comprises a release support base, a release adhesive layer applied to one surface of the support base, the adhesive of the adhesive layer being noninflammable and capable of releasably flocking fibers in a suitable state or erect position to said base, fibers releasably flocked at one end to the base by means of the adhesive layer and printed in a desired design pattern, and a flocked fiber transfer adhesive layer applied to the other ends of the releasably flocked fibers.

The above and other objects and attendant advantages of the present invention will be more readily apparent to those skilled in the art from a reading of the following detailed description in conjunction with the accompanying drawing, which shows preferred embodiments of the invention for illustrative purposes only, but not for limiting the scope of the same in any way.

PREFERRED EMBODIMENTS OF THE INVENTION

Figure 1A:
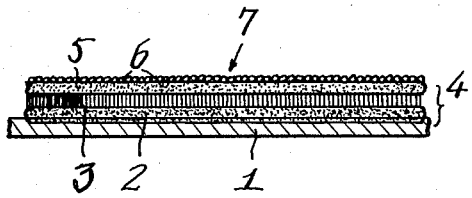
FIG. 1A is a cross-sectional view of a first embodiment of transferable flocked fiber design material of the present invention which comprises a release support base, a release adhesive layer applied to one entire surface of the base, fibers releasably flocked at one end in adjacent and erect relationship to the adhesive applied surface of the base, a flocked fiber tranfer adhesive layer applied to the other ends of the flocked fibers and hot melt adhesive in the form of powder or particle sprinkled over the flocked fiber transfer adhesive layer.

Referring now to the accompanying drawing, and more particularly to FIG. 1A, in which the first embodiment of transferable flocked fiber design material of the present invention is shown, the design material is prepared by uniformly applying a release adhesive layer 2 in a fused state to one entire surface of a release support base 1, which may be a sheet of paper, releasably flocking fibers 3 at one end in adjacent and erect relationship to the adhesive applied surface of the base 1 by electrostatic blasting to form an assembly 4, heat drying the assembly 4, applying a fiber transfer adhesive layer 5 in a fused state to the other or free ends of the flocked fibers 3 by screen printing, and sprinkling hot melt adhesive 6 in the form of powder or particles over the fiber transfer adhesive layer 5 to cause the hot melt adhesive 6 to adhere to the fused fiber transfer adhesive layer 5. The resultant assembly is heat dried to fuse the fiber transfer adhesive layer 5 and hot melt adhesive 6 together to provide a transferable flocked fiber design material 7.

Figure 2A:
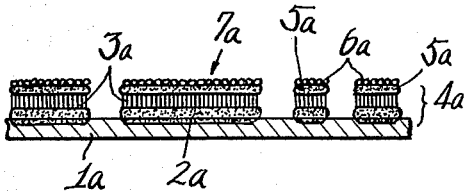
FIG. 2A is a cross-sectional view of a second embodiment of transferable flocked fiber design material of the present invention which comprises a release support base, a release adhesive applied in a desired design pattern to one surface of the base by screen printing or the like, fibers releasably flocked at one end in the desired design pattern to the one surface of the base, a flocked fiber transfer adhesive layer applied to the other ends of the flocked fibers by screen printing or the like, and hot melt adhesive sprinkled over the fiber transfer adhesive layer.

FIG. 2A shows the second embodiment of transferable flocked fiber design material of the present invention in cross section. The transferable flocked fiber design material is prepared by applying a release adhesive layer **2*a* in a fused state in a desired design pattern to one surface of the release support base 1 similar to the base in the first embodiment by screen printing, for example, releasably flocking fibers 3*a* at one end in erect relationship by electrostatic blasting to the area of the one surface of the base 1*a* where the adhesive layer 2*a* is applied in the design pattern to form an assembly 4*a*, heat drying the assembly 4*a*, applying a fiber transfer adhesive layer 5*a* to the other or free ends of the flocked fibers 3*a*, and sprinkling hot melt adhesive 6*a* in the form of powder or particle over the adhesive layer 5*a*. The resultant assembly is heat dried to fuse the fiber transfer adhesive layer 5*a* and hot melt adhesive 6*a* together to provide a transferable flocked fiber design material 7*a***.

Figure 3A:
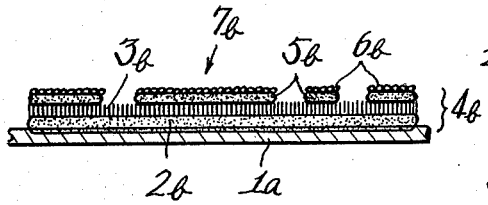
FIG. 3A is a cross-sectional view of a third embodiment of transferable flocked fiber design material of the present invention which comprises a release support base, a release adhesive layer applied to one entire surface of the baee, fibers releasably flocked at one end in adjacent and erect relationship in a desired design pattern by screen printing to the base by means of the adhesive layer, a flocked fiber transfer adhesive layer applied to the other ends of the flocked fibers and hot melt adhesive in the form of powder or particle sprinkled over the fiber transfer adhesive layer.

FIG. 3A shows the third embodiment of transferable flocked fiber design material of the present invention in cross section. The transferable flocked fiber design material is prepared by applying a release adhesive layer **2*b* in a fused state to one entire surface of a release suppot base 1*b*, releasably flocking fibers 3*b* at one end in adjacent and erect relationship to the adhesive applied surface of the base 1*b* by electrostatic blasting to form an assembly 4*b*, heat drying the assembly 4*b*, applying a fiber transfer adhesive layer 5*b* to the other or free ends of the flocked fibers 3*b* in a desired design pattern by screen printing, and sprinkling hot melt adhesive 6*b* in the form of powder or particle over the fiber transfer adhesive layer 5*b*. The resultant assembly is heat dried to fuse the fiber transfer adhesive layer 5*b* and hot melt adhesive 6*b* together to provide a transferable flocked fiber design material 7*b***.

Although the release support base 1 may be formed of cloth, textile, or non-woven fabric, the base is usually formed of a sheet of high quality paper.

The materials forming the release adhesive layer 2 are those comprising acrylic copolymer resin adhesives as the principal component.

One acrylic copolymer resin adhesive useful in the present invention is sold under the trade namer FX-1473 by Nippon Carbide Kogyo K.K. and another is the resin adhesive sold under the trade name FX-1474 by Nippon Carbide Kogyo K.K. The latter was ordered from the Japanese company by the applicant for especially forming the release adhesive layer to be applied to the release support base and FX-1474 is a water-soluble, water-dispersible synthetic resin adhesive comprising 50% of FX-1473 acrylic copolymer resin adhesive blended together with 25% of polyethylene glycol and 25% of paraffin emulsion. FX-1474 is made by taking one liter, for example, of FX-1473, one-half liter of polyethylene glycol, and one-half liter of paraffin emulsion. This would make two liters of the release adhesive FX-1474. The polyethylene glycol and paraffin emulsion are employed to adjust the viscosity and adhesion power of the adhesive.

When applied to the release support base 1, the adhesive of the release adhesive layer 2 is required to partially penetrate into the fiber structure of the support base to unite the support base and release adhesive layer together. Otherwise, in the transfer of the fibers 3 from the transferable flocked fiber design material 7 onto a permanent support member, such as a shirt, by pulling the design material away from the shirt, the release adhesive layer 2 tends to be separated from the release support base 1, together with the fibers 3.

When the free ends of the fibers 3 opposite from the ends thereof releasably flocked to the base 1 are printed in a desired design pattern by screen printing, it is important that the color-printing ink not only fully coats the individual fibers but also penetrates into the structure of the release adhesive layer 2. Otherwise, when the fibers are transferred from the design material 7 onto the shirt in the later step, the ends of the fibers embedded in the release adhesive layer 2 remain uncolored.

The coloring of the individual fibers from one end to the other end means that the printing ink also coats the peripheral surface of the individual fibers and penetrates through the surface of the release adhesive layer into the interior of the adhesive layer by capillary action. In other words, the synthetic resin adhesive which is a component of the printing ink acts on the release adhesive layer.

Therefore, if the fiber transfer adhesive layer applied to the free ends of the fibers and the hot melt adhesive sprinkled over the fiber transfer adhesive layer are heat dried to fuse the hot melt adhesive, which in turn adheres to the flocked fibers to thereby provide a transferable flocked fiber design material, the synthetic resin of the printing ink and the release adhesive layer unite together, i.e., a chemical reaction occur. The united ink synthetic resin and release adhesive layer cause the fibers to be unnecessarily firmly flocked to the base through the release adhesive layer.

The release adhesive layer is required to merely releasably flock the fibers to the base, and should not firmly flock the fibers to the base.

The adhesive for forming the release adhesive layer is required to satisfy the above-mentioned conditions.

The above-mentioned adhesives are selected as satisfying these conditions.

FX-1473 acrylic copolymer resin is a self-bridging, water-soluble adhesive prepared by dissolving 42% of solid component comprising 36% of resin and plasticizer in combination and 6% of emulsifier dissolved in 58% of water and having a viscosity of 1500–2500 cps PH 4–6. When the fibers of the transferable flocked fiber design material, including the release adhesive layer formed of such an adhesive, were transferred onto a shirt, the design pattern obtained by the transferred fibers made the appearance of the shirt unsightly.

This is partially due to the fact that the fibers were excessively firmly secured to the release support base through the release adhesive layer as the result of the use of the above-mentioned acrylic copolymer resin adhesive for the release adhesive layer. The excessive firm flocking of the fibers to the support base is also due to the fact that when the fibers were printed, the synthetic resin contained in the printing ink flowed along the periphery of the full length of the fibers and penetrated into the interior of the release adhesive layer by capillary action and also excessively firmly secured the fibers to the release adhesive layer.

The excessively firm flocking of the fibers to the support base and the weak adhering of the release adhesive layer to the support base also present the problem that in the transfer of the flocked fibers from the transferable flocked fiber design material onto a shirt, fragments of the support base and the adhesive of the release adhesive layer are also separated from the design material together with the fibers.

In order to overcome the above-mentioned difficulties and improve the design pattern formed by the fibers transferred onto a permanent support member to be decorated therewith, such as a shirt, I have made the utmost efforts and found the following facts: (1) in order to firmly secure the release adhesive layer 2 to the release support base 1, it is essential that the adhesive for the release adhesive layer is allowed to partially penetrate into the fiber structure of the base and the assembly 4 is heat dried to thereby firmly unite the base and adhesive layer together after the drying of the adhesive; (2) in order to prevent the base from curling due to the difference in coefficients of contraction between the base and adhesive layer when heat dried to thereby accelerate the printing of the fibers, it is essential that the release adhesive layer is not perfectly dried to maintain the release support base in a limited wet state; and (3) the adhesive forming the release adhesive layer should have the nature which is free of adverse effect by the synthetic resin contained in the printing ink which flows along the fibers and allows the releasably flocked fibers to be easily pulled off the release adhesive layer in the transfer of the fibers from the design material onto a shirt.

In order to satisfy the conditions (1), (2) and (3) enumerated above, the acrylic copolymer resin adhesive sold under the trade name FX-1474 was prepared and the adhesive comprsing FX-1473, polyethylene glycol which satisfies the conditions (1) and (2) and paraffin emulsion which satisfies the condition (3). In preparing FX-1474, one unit of FX-1473 was added thereto 50% of a unit of polyethylene glycol and 50% of a unit of paraffin emulsion, respectively, to adjust the properties of FX-1473 and, accordingly, those of FX-1474.

The use of FX-1474 as the release adhesive layer in the transferable flocked fiber design material prevents the release support base from curling even after a prolonged time of storage of the design material and during the heat drying of the base, release adhesive layer, and flocked fiber assembly, and allows the releasably flocked fibers to be easily separated from the base in the transfer of the fibers onto a shirt without carrying fragments of the release adhesive layer and/or the support base therewith to thereby ensure satisfactory transfer of the fibers.

It has been observed that the release adhesive layer is maintained in a limited wet state after the fibers have been separated from the support base to thereby prove that the release adhesive layer has the function of merely temporarily retaining the fibers on the base.

In the art, it has been believed that the adhesive of the fiber transfer adhesive layer applied to the free ends of the fibers retains the transferred flock on the permanent support member such as a shirt when the adhesive fuses and then dries. However, as mentioned above, since the adhesive of the fiber transfer adhesive layer adheres to both the fibers and permanent support member in the transfer of the fibers, the adhesive gives an unsightly appearance to the design pattern formed by the transferred fibers.

The present invention is based on a concept different from the conventionally accepted concept that the fiber transfer adhesive layer applied to the free ends of the flocked fibers serves to secure the fibers to the shirt and, according to the present invention, the fiber transfer adhesive layer serves to only firmly secure the free ends of the fibers opposite from the ends thereof releasably flocked to the base and the powder or particle hot melt adhesive sprinkled over the fiber transfer adhesive layer serves to secure the fibers and fiber transfer adhesive layer to the permanent support member and bridges between the transfer adhesive layer and permanent support member.

For this reason, the thermoplastic adhesive layer applied to the free ends of the fibers 3 is referred to as the fiber transfer adhesive layer 5. Therefore, the fiber transfer adhesive layer 5 is formed of acrylic synthetic resin emulsion which functions to bridge between the fibers 3 and hot melt adhesive 6 when the transfer adhesive layer is in its dry state and the surface of the adhesive does not fuse at the fusing point of the hot melt adhesive (usually about 120° C.) and the adhesive is added thereto a softener. The fiber transfer adhesive layer 5 formed of the above-mentioned adhesive does not fuse when the hot melt adhesive is fused in the transfer of the fibers and improves its bridging function under heating. Furthermore, even after the transfer of the fibers onto the permanent support member or shirt, the fiber transfer adhesive layer maintains a sufficient flexibility which affords the expansion and contraction of the shirt.

The adhesive in a fused state forming the fiber transfer adhesive layer 5 is applied in a desired design pattern to the free ends of some of the flocked fibers or of all the fibers by screen printing and immediately after the adhesive application, the powder or particle hot melt adhesive 6 is sprinkled over the adhesive layer 5 while in the fused state to secure the fibers and fiber transfer adhesive layer to the shirt.

The purpose of the sprinkling of the powder or particle hot melt adhesive 6 is to secure the hot melt adhesive to the fiber transfer adhesive layer 5, but in fact, the hot melt adhesive is also partially sprinkled over the fibers.

After having been sprinkled over the fiber transfer adhesive layer 5, the powder or particle hot melt adhesive 6 is left as it is to allow the hot melt adhesive to cool down and adhere to the layer 5, whereupon any excess of the hot melt adhesive is removed from the transferable flocked fiber design material.

After the cooling down of the hot melt adhesive, heat is applied to the design material to partially fuse the hot melt adhesive to firmly secure the hot melt adhesive 6 to the fiber transfer adhesive layer 5 to thereby complete the transferable flocked fiber design material. The firm securing of the hot melt adhesive 6 to the fiber transfer adhesive layer 5 is to prevent the powder or particle hot melt adhesive from falling off the fiber transfer adhesive layer 5 while the transferable flocked fiber design material 7 is being stored, transported, and handled for the fiber transfer.

Figure 3B:
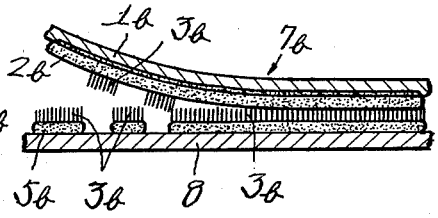
FIG. 3B is a cross-sectional view which shows the manner in which the fibers are transferred from the transferable flocked fiber design material of FIG. 3A in the same manner as described in connection with FIG. 1B.

The transfer of the flocked fibers from the transferable flocked fiber design material onto a permanent support member such as a shirt will now be described referring to the third embodiment of the present invention as shown in FIGS. 3A and 3B.

The transferable flocked fiber design material **7*b* as shown in FIG. 3A comprises a release support base 1*b*, a release adhesive layer 2*b* applied to one entire surface of the base 1*b*, fibers 3*b* releasably flocked at one end in adjacent and erect relationship to the adhesive applied surface of the base 1*b*, a fiber transfer adhesive layer 5*b* applied to the free ends of selected ones of the fibers 3*b* opposite from the ends thereof flocked to the base 1*b* in a desired design pattern by screen printing and powder or particle hot melt adhesive 6*b* sprinkled over the fiber transfer adhesive layer 5*b***.

In the transfer of the flocked fibers **3*b* from the transferable flocked fiber design material 7*b* onto a permanent support member such as a shirt 8, the design material 7*b* is placed onto a shirt 8 with the hot melt adhesive 6 and fiber transfer adhesive layer 5*b* in contact with the shirt 8, and heat and pressure are applied to the design material 7*b* by means of a heating means to fuse the hot melt adhesive 6*b*, which in turn penetrates into the fiber transfer adhesive layer 5*b* and shirt 8 to bridge between the adhesive layer 5 and shirt 8. Thereafter, the design material 7*b* is left as it is to allow the hot melt adhesive to cool down to a degree to firmly secure the design material 7*b* to the shirt 8 and the design material 7*b* is then pulled off the shirt 8 to leave the fibers 3*b*, adhesive layer 5*b* and hot metal adhesive 6*b* on the shirt 8 to thereby complete the transfer of the fibers 3*b***.

Thus, the fiber transfer adhesive layer **5*b* secured to the shirt 8 firmly secures the fibers 3*b* to the shirt 8 and the fibers 3*b* are pulled off the release adhesive layer 2. As a result, the fibers 3*b* are secured in the design pattern corresponding to that defined by the fiber transfer adhesive layer 5*b* to the shirt 8**.

As mentioned above, since the resin of the release adhesive layer **2*b* has adhesion power just sufficient to releasably flock the fibers 3*b* to the base 1*b*, but insufficient to resist the pulling force which separates the design material from the shirt, the fibers can be easly pulled off the release adhesive layer 2*b*, and since the adhesive of the fiber transfer adhesive layer 5*b* has no adhesion function after it has secured the fibers thereto, the fibers 3*b* are transferred onto the shirt 8** in erect position.

The fibers other than those transferred onto the shirt 8 remain on the separated support base **1*b* (see FIG. 3B**).

The second embodiment of transferable flocked design material **7*a* as shown in FIG. 2A is substantially similar to the third embodiment except that the release adhesive layer 2*a* is applied in a desired design pattern to one surface of the release support base 1*a* and, accordingly, the fibers 3*a* are flocked in the same design pattern to the base 1*a***.

The first embodiment of transferable flocked fiber design material 7 as shown in FIG. 1A comprises a release support base 1, a release adhesive layer 2 applied to one entire surface of the base 1, fibers 3 releasably flocked at one end in adjacent and erect relationship to the adhesive applied surface of the base 1 and printed with a desired pattern, a fiber transfer adhesive layer 5 applied to the free or other ends of the flocked fibers 3 and hot melt adhesive 6 sprinkled over the adhesive layer 5. The design material 7 is cut to a suitable or desired shape when the fibers 3 are transferred onto the shirt.

Figure 1B:
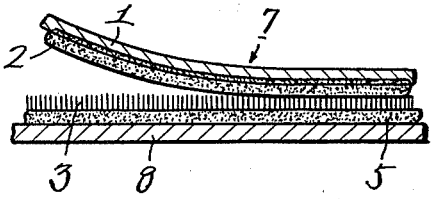
FIG. 1B is a cross-sectional view which shows the manner in which the fibers are transferred from the transferable flocked fiber design material of FIG. 1A onto a shirt by placing the design material onto the shirt with the fiber transfer adhesive layer in contact with the shirt and applying heat and pressure to the design material to fuse the fiber transfer adhesive and hot melt adhesive so as to secure the fibers to the shirt and pulling the design material to permanently transfer and secure the fibers onto and to the shirt.
Figure 2B:
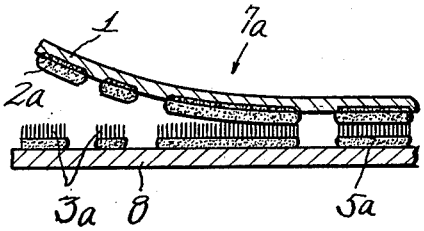
FIG. 2B is a cross-sectional view which shows the manner in which the fibers are transferred from the transferable flocked fiber design material of FIG. 2A onto a shirt in the same manner as described in connection with FIG. 1B.

The fiber transfer operation on the first and second embodiments is the same as that described in connection with the third embodiment hereinabove, as shown, respectively, in FIGS. 1B and 2B.

The features of the transferable flocked fiber design material of the present invention are as follows:

(1) The fiber transfer can be easily performed by the use of a simple heating means such as a domestic iron.

(2) As distinguished from the conventional transferable flocked fiber design materials, the fibers forming the desired design pattern can be directly transferred onto a shirt without the use of any intermediate design pattern means and, thus, the possibility of getting-out-of-shape of the design pattern formed by the fibers, which would otherwise occur because of the raveling of the intermediate design pattern means, is eliminated.

(3) Since the hot melt adhesive employed in the embodiments dries quickly after the adhesive has fused, scraps generated in the cutting of the transferable design material will neither smear nor adhere to the shirt or the like, and the shirt decorated with the transferred fiber design pattern can withstand dry cleaning and other rough handling.

(4) Since the fibers are transferred in the design pattern onto the shirt or the like without any intervening transfer base sheet as required in the transfer of the fibers from the conventional transferable flocked fiber, there is no possibility of the design pattern getting out of shape because of the expansion and contraction of the shirt.

(5) Evan when the release support base is printed with a multicolor or monocolor design pattern, the transfer of the fibers from the printed support base will not be adversely affected.

(6) Since the release adhesive layer is formed of the mixture of acrylic copolymer resin, polyethylene and paraffin emulsion in place of a highly inflammable material such as naphtha, there is no possibility of occurrence of fire at the heat drying step in the preparation of the assembly comprising the release support base, release adhesive layer and fibers.

(7) Since the release adhesive layer contains polyethylene glycol therein, even after the heat drying of the adhesive layer, the adhesive layer still maintains its limited moistened state, and the resulting transferable flocked fiber design material is prevented from curling and/or corrugating.

(8) Since the release adhesive layer further contains paraffin emulsion in addition to polyethylene glycol, even after heat drying the release adhesive layer still maintains a limited moisture content so that any fragment of the adhesive layer will not be dislodged by the fibers in the separation of the fibers from the adhesive layer whereby the transferred fibers will form a well-defined high quality design pattern on the shirt.

While several embodiments of the invention have been shown and described in detail, it will be understood that the same are for illustrative purposes only and are not to be taken as a definition of the invention, reference being had for this purpose to the appended claims.

What is claimed is:

1. A transferable flocked fiber design material comprising a release support base, said base being coated on one surface thereof with a release adhesive layer, fibers releasably flocked at one end thereof in the said release adhesive layer, a fiber transfer adhesive layer applied to the other end of selected ones of said fibers, said fiber transfer adhesive being formed of an acrylic resin adhesive comprising an acrylic resin, a viscosity-imparting agent, a softening agent, and a hot melt adhesive applied over the said fiber transfer adhesive layer, said release adhesive layer comprising about 25% of polyethylene glycol, about 25% of paraffin emulsion and about 50% of an acrylic copolymer resin adhesive, the latter component having a viscosity of 1500–2500 cps, a PH of 4–6, and including about 42% solid content dissolved in about 58% water, said about 42% solid content consisting of about 36% resin and plasticizer and about 6% emulsifier.

2. The transferable flocked fiber design material as set forth in claim 1, in which said selected fibers are printed with a desired design pattern.

3. The transferable flocked fiber design material as set forth in claim 1, in which said fiber transfer adhesive layer is applied in a desired design pattern to the other ends of selected ones of said fibers.

4. The transferable flocked fiber design material as set forth in claim 1, in which said release adhesive layer is in a desired design pattern.

5. The transferable flocked fiber design material as set forth in claim 1, in which the said release adhesive layer is selectively applied in a desired design pattern to said support base.

6. A method for preparing a transferable flocked fiber design material comprising the steps of: applying a release adhesive layer to one surface of a release support base; partially heat treating so as to cause the said adhesive layer to partially penetrate into the said support base; the said release adhesive layer being formed of about 25% of polyethylene glycol, about 25% of paraffin emulsion and about 50% of an acrylic copolymer resin adhesive, the latter component having a viscosity of 1500–2500 cps, a PH of 4–6, and including about 42% of solid content dissolved in about 58% water, said about 42% solid content consisting of about 36% resin and plasticizer and about 6% emulsifier; releasably flocking fibers at one end thereof by electrostatic blasting on the said release adhesive layer to form an assembly; partially heat treating said assembly to result in releasable adhesion of said fibers to the said release adhesive layer; applying a fiber transfer adhesive layer to the other end of said fibers, said fiber transfer adhesive layer being an acrylic resin adhesive; applying hot melt adhesive onto said fiber transfer adhesive layer; removing any excess of said hot melt adhesive; and heat treating the resulting assembly to secure the hot melt adhesive to said fiber transfer adhesive layer, thereby resulting in a transferable flocked fiber design assembly.

7. The method as set forth in claim 6, further including the step of printing said flocked fibers with a desired design pattern before said fiber transfer adhesive layer is applied to said fibers.

8. The method as set forth in claim 6, in which said fiber transfer adhesive layer is applied in a desired design pattern to the other ends of selected ones of said fibers.

* * * * *